United States Patent [19]

Brunaud

[11] 4,232,442

[45] Nov. 11, 1980

[54] REMOVAL OF RESIDUAL STRESSES IN A TUBE SEATED IN A TUBE PLATE

[75] Inventor: Daniel Brunaud, Saint-Germain-du Plain, France

[73] Assignee: Framatome, Courbevoie, France

[21] Appl. No.: 8,400

[22] Filed: Feb. 1, 1979

[30] Foreign Application Priority Data

Feb. 3, 1978 [FR] France ..... 78 03131

[51] Int. Cl.[3] ..... B21D 39/06; B23P 15/26

[52] U.S. Cl. ..... 29/727; 72/122

[58] Field of Search ..... 29/727, 157.3 C, 157.4; 72/112, 120, 126, 122, 125, 122

[56] References Cited

U.S. PATENT DOCUMENTS 3,854,314 12/1974 Martin ..... 29/727 X 3,979,810 9/1976 Krips et al. ..... 29/727 X

*Primary Examiner*—Milton S. Mehr

*Attorney, Agent, or Firm*—Haseltine, Lake & Waters

[57] ABSTRACT

Apparatus for removing residual stresses produced in a tube by seating the tube in a bore in a tube plate, the tube having one end flush with one face of the tube and extending from the other face and being seated in the plate by expanding and rolling the tube at the level of the plate up to a transition zone in the region of emergence of the tube from the other face of the plate, the apparatus comprising an elongate tubular element having a cage at one end provided with longitudinal recesses housing radially movable wheels and a control rod which is axially movable in the element to cause the wheels to project radially from the cage and rotatable to rotate the wheels, the portion of the rod in contact with the wheels being conical and the axes of the wheels being inclined to the axis of the tubular element, an adjustable stop for precisely positioning the wheel cage at the level of the transition zone of the tube, and control means for causing axial movement of the rod to bring the wheels into contact with the tube in the transition zone, for then causing a preset number of revolutions of the rod, and for then stopping axial and angular movement of the rod.

3 Claims, 3 Drawing Figures

REMOVAL OF RESIDUAL STRESSES IN A TUBE SEATED IN A TUBE PLATE

The invention relates to apparatus for removing the residual stresses produced in a tube by a seating operation.

During the manufacture of steam generators or other heat exchangers, it is necessary to fix a large number of tubes to one or two tube-plates located at the ends of the tubes, and this assembly must be extremely leaktight and strong.

For a long time, each tube has been fixed in the interior of each tube-plate, through which a bore having a diameter which is slightly greater than the external diameter of the tube passes completely, by a welding operation followed by an expansion of the tube inside the bore, that is to say by a seating operating during which the tube is rolled by wheels against the bore, its thickness being reduced and the fixing obtained being extremely leaktight and strong.

The tube is fixed to the tube-plate so that it extends from the internal face of the tube-plate, the other end of the tube being flush with the external face of the tube-plate.

The operation of expanding the tube, placed in the bore in the tube-plate, consists in expanding the tube in such a way that its external surface comes into contact with the bore, in a first stage, and then in continuing to deform the tube by rolling its wall again the bore.

This expansion is generally carried out over a length of tube which approximately corresponds to the thickness of the tube-plate.

The zone of the tube in which the deformation stops, which is referred to as the transition zone, can be located, relative to the tube-plate, either inside or beyond the bore and in the region of the internal surface of the tube-plate through which the tube emerges, or exactly at the level of the internal surface of the plate.

Tubes of steam generators and heat exchangers are generally subject to corrosion and to mechanical fractures at the level of the transition zone. It has been noticed that the cause of this corrosion and of these mechanical fractures is essentially an abnormally high concentration of residual stresses in the tubes at the level of the transition zone. The operation of integral expansion of the tube, with reduction in the thickness of the tube at the level of the tube-plate, in fact induces high residual stresses, in particular in the region of the external and internal surfaces of the tube, in the transition zone.

The seating (or expansion) of the tubes on the tube-plate is generally carried out with a tool comprising an elongate tubular element which is mounted by one of its ends so as to rotate on a support and forms, at the other end which is farther from the support, a cage possessing housings in which wheels are located.

A conical rod, which is coaxial with and extends through the tubular element and the wheel cage, makes it possible to rotate these wheels and to move them in the radial direction inside their housings, so that they project relative to the external surface of the cage for performing the expansion by action of the wheels on the internal surface of the tube at the level of the bore of the tube-plate and in the region thereof.

A device for causing rotation and thrust in the longitudinal direction of the rod makes it possible to actuate the wheels and to carry out the seating of the tube over the entire length of the wheels up to the desired reduction in thickness (3 to 5%). When the desired level of deformation is reached, the tool is removed by withdrawing the rod from the cage and the tool is placed in the succeeding zone of the tube in order to carry out a further seating operation therein, over a length corresponding to the length of the wheels.

This tool or tube-expander generally comprises three or four wheels. The stepwise movement of the tool inside the tube over the entire zone of the tube in the bore allows, firstly, expansion of the tube, the external diameter of which is slightly less than the internal diameter of the bore, and the rolling of the wall of the tube against the wall of the bore.

All the tubes in the tube-plate are therefore expanded succesively by introducing the tubular element of the tool comprising the wheel cage inside each of the tubes, by setting in operation the device for causing rotation and thrust on the rod for actuating the wheels, and by moving the tool stepwise inside the bore.

Other expansion processes are also known, but none of these processes makes it possible to avoid the production of high residual stresses at the level of the transition zone.

Processes and devices making it possible to remove these residual stresses after expansion have been proposed.

For example, it has been proposed to roll the internal surface of the tube in its enlarged zone inside the tube-plate. It has also been proposed to carry out a differential expansion, it being possible for the deformation of the wall of the tube along the bore to vary according to an established programme.

However, these processes, which are fairly complex to carry out, do not make it possible to completely remove the residual stresses at the level of the transition zone on the external skin of the tubes.

A process in which the tube is expanded at the level of the transiton zone in such a way that its internal diameter and its external diameter are increased without performing rolling, the external diameter of the tube remaining less than the diameter of the bore after expansion, would make it possible to remove the residual stresses satisfactorily.

However, no equipment is known which makes it possible to expand the tube rapidly and easily to a precise extent at a given point in this tube, which corresponds to the transition zone, and for carrying out this process on a large number of tubes, as in the case of the tube-plates of the heat exchangers in nuclear power stations.

According to the invention there is provided apparatus for removing residual stresses produced in a tube by an operation of seating the tube in a bore passing completely through a plate of high thickness, the tube being arranged relative to the plate with one of its ends flush with one of the faces of the plate and extending from the other face of the plate, the seating of the tube being carried out by expanding and rolling the tube at the level of the plate up to a transition zone in the region of emergence of the tube from the other face of the plate, said device comprising:

a support carrying control means and adapted to permit handling of the apparatus;

an elongate tubular element which is mounted by one end for rotation about its axis in said support, and provides in its other end portion a generally tubular cage having a plurality of longitudinal recesses therethrough, each recess serving as a housing for a wheel which is mounted so as to be radially movable therein between an operative position projecting partially outside said cage and a retracted position retracted completely within said cage, said wheels having axes of rotation which make a small angle with the axis of said tubular element;

a rod for controlling the wheels, which extend within, and is coaxial relative to, said tubular element and comprises at one end a terminal part of generally conical shape which penetrates into the interior bore of said cage in contact with said wheels, and is connected at its other end to a motor for causing rotation thereof and to a jack for moving the rod in the axial direction relative to the tubular element, said motor enabling rotation of said wheels by frictional contact with said rod, and said jack enabling movement of said wheels in the radial direction between their operative and retracted positions by axial movement of the rod;

an adjustable stop carried by said support and for contacting the one face of the plate for precisely positioning the wheel cage at the level of the transition zone of a tube; and control means for controlling the rotational and translational motions of the rod, relative to the tubular element, to permit an exactly controlled expansion of the tube at the level of the transition zone, said control means comprising means for actuating said jack to cause movement of said rod in a direction to move said wheels from said retracted position towards said operative position, means for actuating said motor when said rod comes to rest against said wheels, means for counting the revolutions performed by said rod and for deactuating said motor and said jack after a preset number of revolutions have been performed by said rod.

In order to provide a clear understanding of the invention, an embodiment of apparatus according to the invention, and the use of this apparatus for removing the stresses in a steam generator tube, will now be described by way of example only, with reference to the accompanying drawings.

Figure 1:
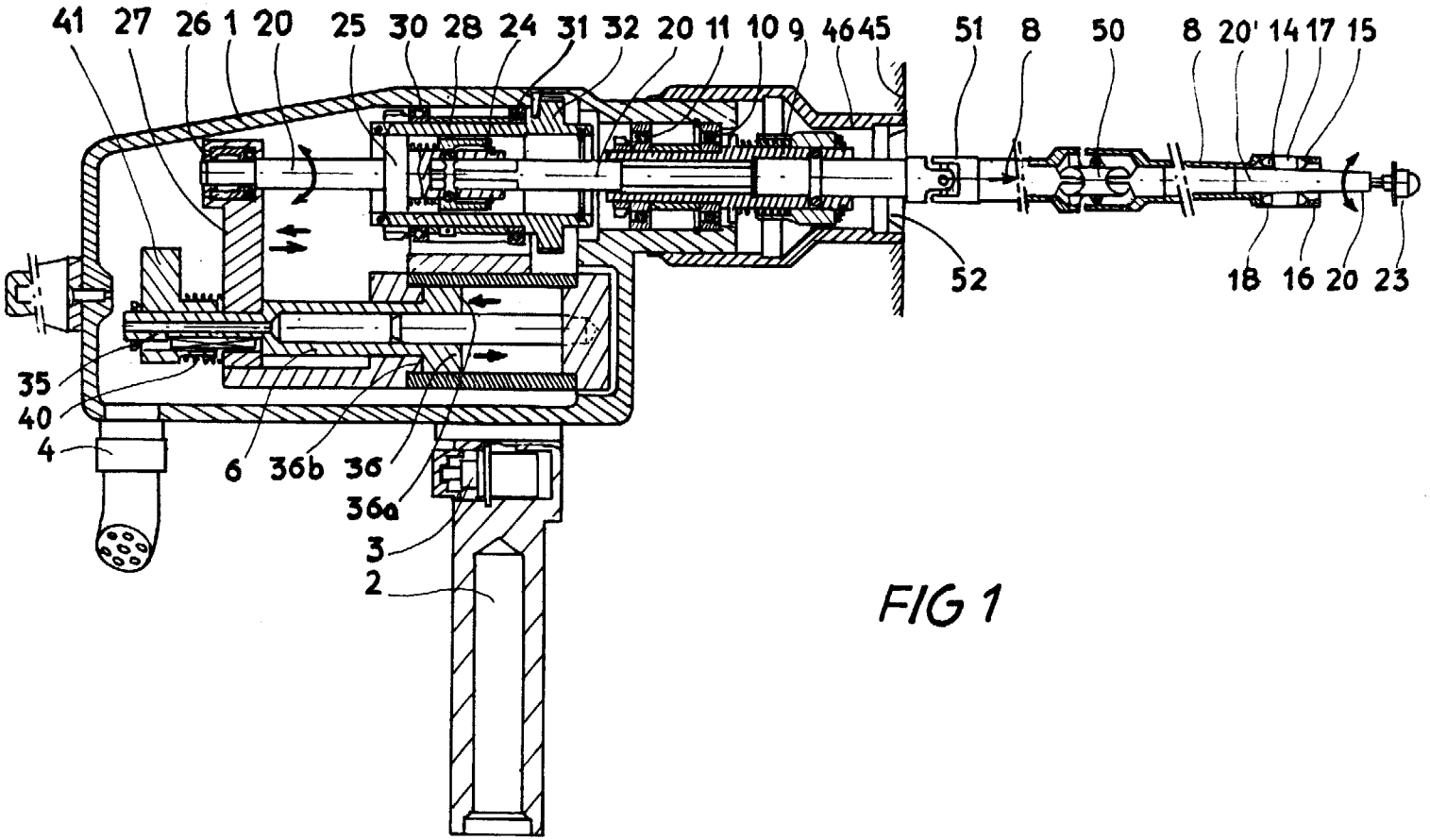
FIG. 1 represents a sectional view of an embodiment of apparatus according to the invention through its plane of symmetry.

The apparatus shown in FIG. 1 comprises a support 1 which constitutes the main body of the tool and inside which are located drive and control members therefor.

The support 1 comprises a casing, at the base of which is located a grip 2 which makes it possible to handle the tool and carries a control button 3 for starting and stopping the tool.

Figure 2:
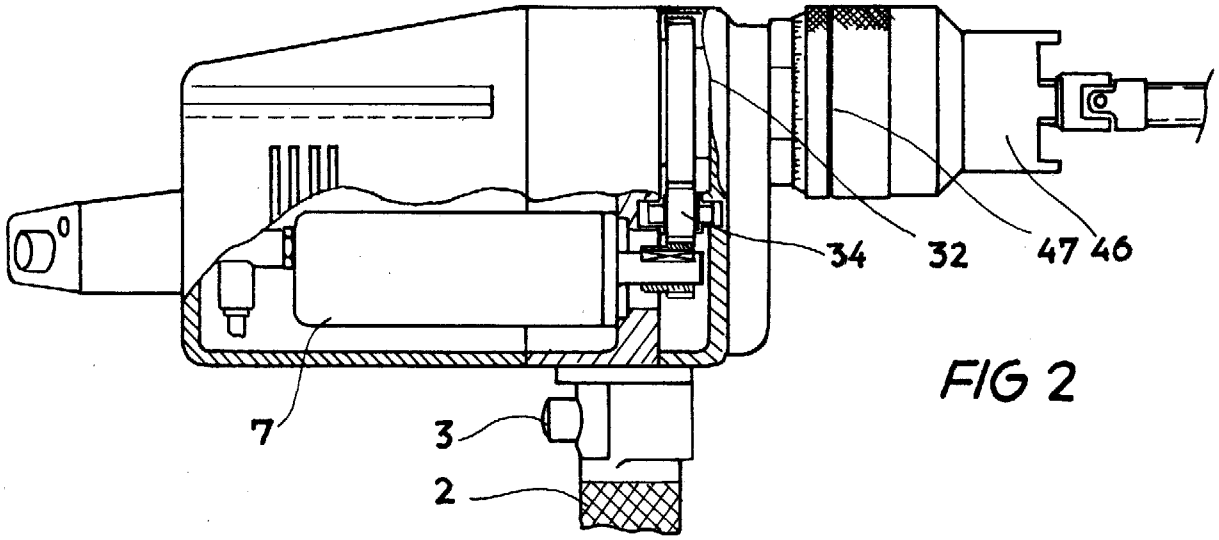
FIG. 2 shows a part side part sectional view of the body of the apparatus of FIG. 1, showing a vernier device which permits the precise positioning of the wheel cage in the tube.

A multiple intake 4, for supplying electric current and fluid to the drive of the tool, is also fixed to the casing FIGS. 1 and 2 show the various drive members of the apparatus, which are located inside the support 1.

These drive members comprise a compressed-air jack 6 and a pneumatic motor 7, the structure and control means of which will be described in greater detail below.

The apparatus also comprises an elongate tubular element 8 which, at one of its ends, is integral or fast with an element 9 which is mounted for rotation by means of bearings 10 and 11 located in the support 1. The elongate tubular element 8 can thus rotate about its axis relative to the support 1 in which it is mounted, but is prevented from moving in the axial direction by the movable element 9.

At the end which is not joined to the support 1, the tubular element 8 comprises a part 14 which has a larger diameter than the adjacent parts of the tubular element and constitutes a cage possessing five recesses, such as 15 and 16 shown in FIG. 1.

The recesses, such as 15 and 16, pass through the wall of the tubular element 8 and consequently emerge inside the hollow central part of the element 8.

Inside the recesses in the cage 14 are located elongate wheels, such as 17 and 18, which are very slightly conical and the axes of which are slightly inclined towards the axis of the cage 14 in their rest position, shown in FIG. 1. In this rest position, the wheels are completely retracted in their housings formed by the recesses 15 and 16, situated in the cage 14.

FIG. 1 also shows a control rod 20 which is located inside the tubular element 8, its axis coinciding with the axis of the tubular part 8.

The end part 20' of this rod 20 has a conical shape, the cross-section of this control part decreasing towards the free end of the tubular element 8. The rod 20 passes completely through the tubular element 8, the terminal part of the part 20' of this rod emerging at the free end of the element 8. The rod 20 therefore passes through the central bore of the cage 14 where it comes into contact, by means of its conical part 20', with the wheels, such as 17 and 18.

The shape of the housings, such as 15 and 16, situated in the cage 14, is such that the wheels are movable in the radial direction, so as to move away from or approach the axis of the tubular part, whilst being retained by the housing, regardless of their position.

Figure 3:
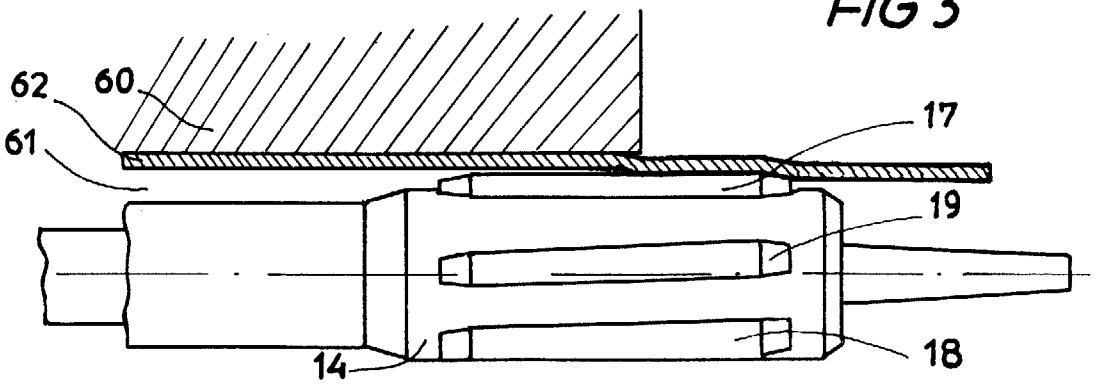
FIG. 3 shows the end of the apparatus in position in the zone of the tube which has been subjected to expansion.

FIG. 3 shows wheels 17, 18 and 19 in a projected position outside the cage 14.

These various positions of the wheels 17, 18, 19 are obtained by the longitudinal motion of the rod 20, the conical part 20' of which remains in contact with the wheels. When the rod is moved axially towards the free end of the tubular element 8, the wheels are caused thereby to emerge. Regardless of their radial position relative to the tubular element, the axes of the wheels are slightly inclined relative to the axis of the tubular element.

At its external end, the rod 20 comprises a stop 23 for limiting its axial movement.

The inner end portion of the rod 20 is fixed to a movable element 24 which is itself integral or fast with a pinion 25 connected to the rear end of the rod 20, which is engaged in a bearing 26 integral or fast with a travelling carriage 27.

The pinion 25 is engaged in internal teeth in a sleeve 28, the axis of which coincides with the axis of the rod 20, and which is mounted for rotation by two bearings 30 and 31, located inside the support 1.

The teeth in the sleeve 28 are machined over a length corresponding to the stroke of the rod 20 in the axial direction.

The pinion 25 and the rod 20, either directly or via the element 24, are therefore fixed relative to the sleeve 28 for rotation but are free to move axially relative to the sleeve 28.

The external surface of the sleeve 28 is machined to form a pinion 32 which makes it possible to rotate the sleeve and the rod 20.

As shown in FIG. 2 the pinion 32 is rotated by the motor 7 via gears, such as 33 and 34, which make it possible to obtain a certain step-down ratio.

The rod 20 is fixed relative to the carriage 27 for translational motion of the carriage 27, but is free to rotate relative to the carriage 27 because of the bearing 26.

The carriage 27 is itself connected to the rod 35 of the pneumatic jack 6, the piston 36 of which moves in the chamber of the jack which is fast with the support 1. The piston 36 is guided during its movements by a rod 37 which is fixed to the chamber of the jack. Seals 38 and 39 make it possible to provide leaktightness between the piston and the chamber of the jack and the guide rod 37.

The piston 36 possesses a face 36*a* on which the compressed air acts to retract the piston towards the rear of the apparatus, and a face 36*b* on which the compressed air acts to advance the piston and the rod 35 towards the front of the apparatus.

The double-action jack 6 is thus fed with compressed air so as to effect a forward motion or a backward motion.

When the jack effects a backward motion, the rod 35 contacts and pushes the carriage 27 backward which in turn drives the rod 20 with a backward motion to the extreme position shown in FIG. 1, in which the rod 20 is retracted to the maximum extent. In this position, the wheels 17, 18, and 19 are completely retracted in their housing.

The rod 35 acts on the rear face of the carriage 27, in order to move the carriage in the forward direction, by a spring 40 bearing on the carriage and an actuating element integral or fast with the end of the rod 35.

In its forward motion, the carriage 27 is therefore driven by a thrust exerted on it by the element 41, connected to the rod 35, via the spring 40, when the compressed air acts on the face 36*b* of the piston 36.

The carriage 27 carries a contact (not shown) which actuates the motor 7 to rotate the rod 20 when the contact is actuated by the element 41 during motion of the element 41 relative to the carriage 27.

A vernier 47 permits an extremely precise adjustment of the position of a stop 46 which, when it comes into position on the external face 45 of a tube-plate, permits an extremely precise positioning, at depth in the tube on which the operation for the removal of the stresses is carried out, of the active part of the tool, which consists of the wheel cage 14.

In order to improve the conditions of use of the equipment, in particular in the case where operations are carried out on the tubes of a steam generator in a nuclear power station, which tubes have already been placed in position, deflection pieces are provided on the rod 20 and on the tubular element 8. Thus, a double universal joint 50 is provided in the rod 20 and a single universal joint 51 is provided in the tubular element. The apparatus can thus be used for removing stresses in tubes which would not be accessible to apparatus comprising a rigid tube and a rigid rod.

A marker 52 has also been provided on the tubular element. The marker 52, which is integral or fast with a rotary part of the apparatus during removal of the stresses or expansion counter-treatment, marks a circle on the fixed piece which is opposite thereto during this operation, that is to say the external face of the tube-plate, the circle indicating that the expansion counter-treatment has been carried out on the corresponding tube.

This marking is extremely useful for the operator, because the number of tubes per tube-plate is extremely large and it is thus possible to avoid any error or oversight.

An expansion counter-treatment will now be described with reference to FIGS. 1, 2 and 3.

FIG. 3 shows the tube-plate 60, in the bore 61 of which a tube 62 has been expanded, that is to say the tube has been expanded along its diameter with a reduction in the thickness of this tube, up to a distance of the order of 3 mm from the internal face of the tube-plate. In the region of the point where the tube emerges from the plate, the expansion of the tube has not therefore been continued and the tube thus remains detached from the wall over this short length which corresponds to the zone in which the residual stresses in the external skin are greatest.

Once the expansion operation has been carried out, the apparatus shown in FIGS. 1 and 2, with its wheels 17, 18, 19 retracted as shown in FIG. 1, is brought opposite the transition zone, as shown in FIG. 3.

In practice, at the start of the operation on a tube-plate, the stop 46 is first adjusted to the correct position and it then suffices for the operator to determine the exact position of the transition zone, relative to its reference position, and makes a correction of position by means of the vernier 47.

When the correction has been carried out, the tool is introduced into the tube until it can enter no further. The active part of the apparatus, which consists of the wheel cage 14, is then in its position, shown in FIG. 3, opposite the transition zone, the middle of the wheels being at the level of the transition zone. The tool is then in the correct position for starting the expansion counter-treatment. The operator actuates the contact button 3, which causes opening of an electro-valve to supply the rear chamber of the jack 6 with compressed air, the compressed air acting on the face 36*b* of the piston 36 to cause it to advance. This causes an identical motion of the rod 35 and of the carriage 27 which is connected to the rod 20 for translation. The forward translational motion of the rod 20 causes movement of the wheels in the radial outward direction, so that the wheels project relative to the cage 14 as shown in FIG. 3, until they contact the internal surface of the tube 62. The forward motion of the rod 20 is then stopped and this causes the carriage 27 to stop.

Whilst the forward motion of the rod 35 continues, the element 41 approaches the carriage 27, compressing the spring 40, and actuates the contact, actuating the motor 7.

The rod 20 is then caused to rotate and its conical part 20', in frictional contact with the wheels of the cage 14, causes these wheels to rotate at the same time as a certain radial thrust is exerted on these wheels by the rod 20 which is still subjected to the thrust of the jack 6.

The wheels cause the cage 14 to rotate about its axis with the result that the wheels travel round the bore of the tube over the entire zone of contact. This rolling of the wheels causes a widening of the tube, which in turn makes it possible for the rod 20 to advance, causing a greater separation of the wheels and a further expansion of the tube 62 at the level of the transition zone.

The number of revolutions performed by the equipment is counted and this corresponds to a certain widening of the tue, taking into account the pressure exerted by the pneumatic jack.

A device connected to the rod, or an element which can move each time the control rod rotates, makes it possible to act on a contact when the rod has been rotated by a certain number of turns.

Thus, when a given widening has been reached, the contact is actuated and acts on a servo-valve, causing the rotational and translational motions of the rod 20 to stop and then causing a change in the direction of rotation of the rod 20 and reversal of the feed to the jack 6, making it possible to cause the compressed air to act on the face 36*a* of the piston 36 to free the wheels and retract the apparatus from the tube.

It should be noted that the cycle of operations is automatic as from the moment when the control button 3 has been actuated by the operator.

In the case of tubes having an external diameter of 22.22 mm, with tolerances of +0.13 and −0.18 mm on these diamaters, and a wall thickness of 1.27 mm, with a tolerance of ±0.12 mm, the diameter of the bore being 22.60 mm, with tolerances of +0.08 mm and −0.05 mm, it has been observed that an increase of 0.15 mm in the diameter of the tubes during the expansion operation, carried out by the apparatus described above, causes a complete removal of stress in the tubes when operating in tubes which have been subjected to an integral expansion up to a level which is a few millimeters inside the bore, relative to the internal face of the tube-plate.

In this case, it is seen that the increase in diameter has been restricted to a value which prevents the external surface of the tube from coming into contact with the surface of the bore in the transition zone during the expansion causing a removal of the residual stresses. The rolling of the tube against the bore is thus avoided.

It is seen that the expansion counter-treatment performed has been carried out at the level of the transition zone and over a part of the tube which extends beyond this zone towards the inside of the secondary part of the steam generator, so that the wall thickness of the tube remains essentially constant during this expansion.

The removal of residual stresses has been checked by means of a test using boiling magnesium chloride, within the entire range of variation of the dimensions included in the tolerances given above, on models representative of the steam generator.

It is therefore seen that the removal of the stresses has been carried out by means of an operation which is extremely simple and easy for the operator to carry out, the succession of the operations being carried out automatically.

Furthermore, the production of the apparatus in an articulated form makes it possible to use it under conditions of difficult accessibility.

Of course, the example of an embodiment which has now been described in no way implies a limitation and it is possible to modify points of detail without thereby going outside the scope of the invention. In particular, the description also holds in the case where the transition zone is outside the bore.

It is possible to conceive of a device for causing the rotation and translation of the rod controlling the wheels, which is different from that which has been described. It is also possible to use any type of device for counting the number of revolutions of the rod.

It is also possible to conceive of a device for adjusting the depth of the tool in the tubes, which is different from that which has been described with reference to FIGS. 1 and 2.

Finally, the above described device is useful in the removal of residual stresses after the expansion of tubes, not only in the tube-plates of steam generators, such as those used in nuclear reactors, but also in any other support or plate of a heat exchanger.

I claim:

1. Apparatus for removing residual stresses produced in a tube by an operation of seating the tube in a bore passing completely through a plate of high thickness, the tube being arranged relative to the plate with one of its ends flush with one of the faces of the plate and extending from the other face of the plate, the seating of the tube being carried out by expanding and rolling the tube at the level of the plate up to a transition zone in the region of emergence of the tube from the other face of the plate, said device comprising: a support adapted to permit handling thereof; an elongate tubular element defining a longitudinal axis; means mounting one end of said tubular element in said support for rotation about said longitudinal axis; a generally tubular cage provided in the other end portion of said tubular element and defining a plurality of longitudinally extending recesses therethrough; a wheel in each said recess which serves as a housing therefor; means mounting each said wheel in said respective recess such that said wheel is radially movable therein between an operative position projecting partially from said cage and a retracted position within said cage, said wheels having axes of rotation which make a small angle with said longitudinal axis; a rod for controlling said wheels, said rod extending coaxially within said tubular element and comprising at one end a terminal part of generally conical shape which penetrates into the interior bore of said cage and contacts said wheels; a motor for causing rotation; a jack for causing linear movement; means connecting said motor to said rod for rotating said rod about said longitudinal axis to cause rotation of said wheels by frictional contact with said wheels; means connecting said jack to said rod for moving said rod in the direction of said longitudinal axis relative to said tubular element to cause radial movement of said wheels; an adjustable stop for contacting the one face of said plate for precisely positioning said wheel cage in a tube at the level of the transition zone thereof; means mounting said stop on said support; control means for controlling rotational and linear movement of said rod relative to said tubular element to permit an exactly controlled expansion of the tube in the transition zone, and comprising means for actuating said jack to cause movement of said rod in a direction to move said wheels from said retracted position towards said operative position, means for actuating said motor when said rod comes to rest against said wheels, means for counting the revolutions performed by said rod and for deactuating said motor and said jack after a preset number of revolutions have been performed by said rod, said means for actuating said motor being defined by a carriage connected to said control rod for linear movement thereof and connected to the rod of said jack by direct contact for movement of said control rod in a direction causing retraction of said wheels, and by means of an actuating element bearing on said carriage via an axially elastically deformable member for movement of said rod in a direction causing radially outward movement of said wheels; and an electrical contact carried by said carriage for controlling actuation of said motor and operable by said actuating element which moves relative to said carriage when said rod comes to rest against said wheels.

2. Apparatus according to claim 1, wherein said tubular element and said control rod each comprise a plurality of parts connected by universal joints.

3. Apparatus according to claim 1 or claim 2, comprising a rotatable element carrying a marking device arranged to come into contact with the one face of the plate to mark the plate during operation of the apparatus.

* * * * *